US009889621B2

(12) United States Patent
Bauersachs et al.

(10) Patent No.: US 9,889,621 B2
(45) Date of Patent: Feb. 13, 2018

(54) PRESS AND METHOD FOR PRESSING WORKPIECES

(75) Inventors: Lothar Bauersachs, Weidhausen (DE); Herbert Ruger, Schneckenlohe (DE)

(73) Assignee: LANGENSTEIN & SCHEMANN GMBH, Coburg (DE)

( * ) Notice: Subject to any disclaimer, the term of this patent is extended or adjusted under 35 U.S.C. 154(b) by 1118 days.

(21) Appl. No.: 13/955,403

(22) PCT Filed: Feb. 2, 2012

(86) PCT No.: PCT/EP2012/051789

§ 371 (c)(1),
(2), (4) Date: Oct. 17, 2013

(87) PCT Pub. No.: WO2012/104384

PCT Pub. Date: Aug. 9, 2012

(65) Prior Publication Data

US 2014/0318390 A1 Oct. 30, 2014

(30) Foreign Application Priority Data

Feb. 2, 2011 (DE) ..... 10 2011 000 473

(51) Int. Cl.
*B30B 15/00* (2006.01)
*B30B 1/32* (2006.01)
(Continued)

(52) U.S. Cl.
CPC ..... *B30B 15/0052* (2013.01); *B21J 9/12* (2013.01); *B21J 9/20* (2013.01); *B30B 1/32* (2013.01); *B30B 13/00* (2013.01); *B30B 15/16* (2013.01)

(58) Field of Classification Search
CPC ..... B30B 1/32; B30B 1/323; B30B 15/16; B30B 15/161; B30B 15/163;
(Continued)

(56) References Cited

U.S. PATENT DOCUMENTS 2,103,888 A 12/1937 Bowen
4,168,918 A 9/1979 de Jonge
(Continued)

FOREIGN PATENT DOCUMENTS

CN 101003062 7/2007
DE 4029824 3/1992
(Continued)

*Primary Examiner* — Jimmy T Nguyen
(74) *Attorney, Agent, or Firm* — Workman Nydegger

(57) ABSTRACT

A press for pressing workpieces can have a) at least two pressing tools and at least one slide that performs working movements with an associated working stroke, b) at least one hydraulic slide drive unit for the slide, which separates a first sub-chamber and a second sub-chamber of a working chamber, and c) at least one slide position measurement device. Additionally, the press can include d) at least one medium reservoir, e) at least one first hydraulic delivery device connected to the first sub-chamber and to the medium reservoir, and f) at least one second hydraulic delivery device. The press can further include g) at least one controllable hydraulic valve, and h) a control device that checks the volumetric flows, pressures, and flow direction of hydraulic medium as a function of the measured slide position and stored or desired movement profiles of the slide and/or of input information from users.

13 Claims, 4 Drawing Sheets

(51) Int. Cl.

| | |
|---|---|
| ***B30B 15/16*** | (2006.01) |
| ***B30B 13/00*** | (2006.01) |
| ***B21J 9/20*** | (2006.01) |
| ***B21J 9/12*** | (2006.01) |

(58) Field of Classification Search
CPC ..... B30B 15/0052; B30B 13/00; D21D 5/02; D21J 9/12; D21J 9/20; B21D 5/02; B21J 9/12; B21J 9/20
See application file for complete search history.

(56) References Cited

U.S. PATENT DOCUMENTS

| | | | | |
|---|---|---|---|---|
| 4,215,543 | A | 8/1980 | Miller | |
| 4,321,818 | A | 3/1982 | Bessho | |
| 4,944,669 | A | 7/1990 | Zakich | |
| 6,205,780 | B1 | 3/2001 | Zervas | |
| 6,240,758 | B1 | 6/2001 | Nagakura | |
| 6,370,873 | B1 * | 4/2002 | Schaich | B30B 15/161 60/413 |
| 2004/0223404 | A1 | 11/2004 | Hughes | |
| 2005/0286984 | A1 | 12/2005 | Weise | |
| 2011/0226141 | A1 * | 9/2011 | Kohno | B21D 24/02 100/269.01 |

FOREIGN PATENT DOCUMENTS

| | | |
|---|---|---|
| DE | 19680008 | 1/2002 |
| DE | 102008039011 | 2/2010 |
| DE | 102008053766 | 4/2010 |
| EP | 116024 | 8/1984 |
| EP | 1815972 | 8/2007 |
| RU | 53217 | 5/2006 |
| WO | WO2009065509 | 5/2009 |
| WO | WO2012104384 | 8/2012 |
| WO | WO2012131071 | 10/2012 |

* cited by examiner

PRESS AND METHOD FOR PRESSING WORKPIECES

CROSS-REFERENCE TO RELATED APPLICATIONS

This application is a 35 U.S.C. § 371 U.S. National Stage of PCT/EP2012/051789, filed Feb. 2, 2012, which claims priority to German Patent Application No. DE 10 2011 000 473.4, dated Feb. 2, 2011.

BACKGROUND OF THE INVENTION

1. Field of the Invention

The invention relates to a press for pressing workpieces and a method for pressing workpieces.

2. Background and Relevant Art

Various forming machines (presses) (see, for example, VDI-Lexikon Band Produktionstechnik Verfahrenstechnik [Production Engineering Process Engineering], Publisher: Hiersig, VDI-Verlag, 1995, pages 1107 to 1113) are known for pressing workpieces in the case of cold forming, in particular in the case of sheet metal forming, or warm forming, in particular in the case of forging of metallic forgeable materials. At least one slide with a first pressing tool of the press is driven by a drive and moved relative to a second pressing tool of the press so that the workpiece can be formed by pressing forces between the pressing tools.

The mechanical presses which generally operate in a travel-dependent manner use mechanical drives, for example, servomotor drives, with a very wide range of transmission mechanisms, for example, eccentric drive mechanisms (eccentric presses) or toggle drive mechanisms (toggle presses). The forming force or slide force is dependent on the travel or the position of the slide.

The mechanical components of mechanical presses are subject to significant strain as a result of the high forces which occur during pressing operations, as a result of which their performance is limited. Weight compensation of the slide is furthermore generally required.

The hydraulic presses which generally operate in a force-dependent manner use a hydraulic drive by means of a hydraulic medium such as oil or water, the pressure energy of which is converted by pistons running in hydraulic cylinders into mechanic forming work. The slide force corresponds to the product of hydraulic pressure and piston surface and is largely independent of the position of the slide. The hydraulic drive of the piston can be a direct pump drive with a motor-driven controllable pump (see e.g. DE 196 80 008 C1) or also a hydraulic accumulator drive with a pressure accumulator and motor-driven pump for producing the pressure in the pressure accumulator. The technical and energy outlay for output-regulated hydraulic pumps is nevertheless relatively high.

BRIEF SUMMARY OF THE INVENTION

The object of the invention thus lies in making available a new press and a new pressing method.

This object is achieved according to the invention by a press with the features of claim 1 and a method according to claim 7. Advantageous configurations and further developments of the inventions will become apparent from the dependent claims.

A movement profile refers in particular to a travel/time profile or speed/time profile or speed/travel profile or force/time profile or force/travel profile.

BRIEF DESCRIPTION OF THE DRAWINGS

The invention is explained in greater detail below on the basis of exemplary embodiments. Reference is also made to the drawings, in which.

DETAILED DESCRIPTION OF THE PREFERRED EMBODIMENTS

Figure 1:
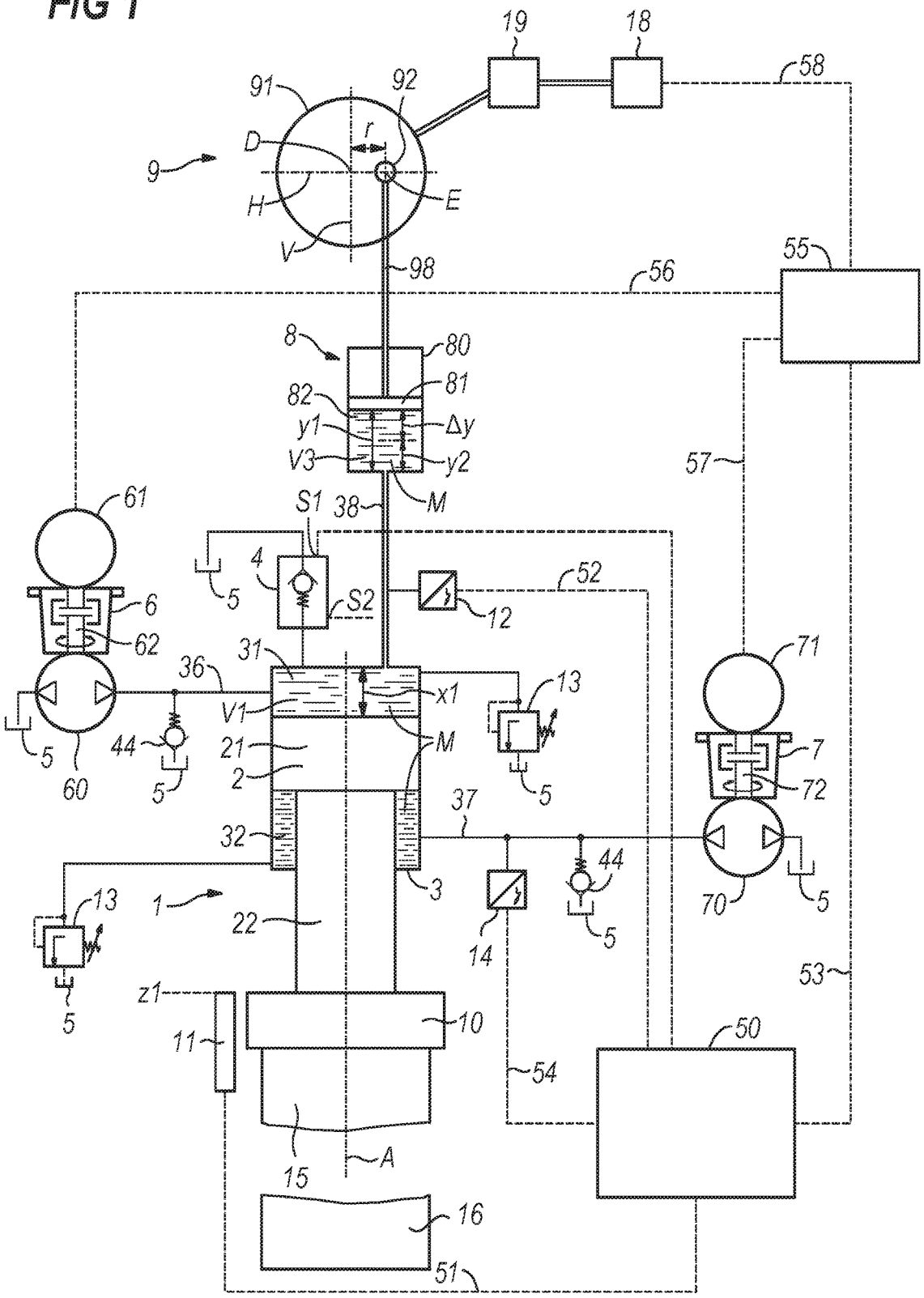
FIG. 1 shows a hydraulic press with an eccentric drive mechanism, in the case of which the working piston is in an upper position, in a circuit diagram.

In all the exemplary embodiments of hydraulic press 1 according to FIGS. 1 to 4, said press 1 comprises a slide 10 and a hydraulic slide drive unit 1 with a hydraulic working piston 2 which is hydraulically movable axially with respect to working axis A in an associated hydraulic or working cylinder 3 filled with hydraulic medium M. A first piston region 21 of working piston 2 adjusted in terms of its outer diameter to the inner diameter of working cylinder 3 and sealed off from the inner surface of working cylinder 3 separates in this case a lower cylinder space 32 of working cylinder 3 from an upper cylinder space 31 in a pressure-tight manner—at least within leakage tolerances. A second piston region 22 of working piston 2 configured to be smaller in terms of outer diameter than first piston region 21 and formed here as a piston rod runs through lower cylinder space 32 so that only the annular or hollow-cylindrical region of lower cylinder space 32 surrounding second piston region 22 is filled with hydraulic medium M.

Working piston 2 moves slide 10, coupled or fastened thereon, of press 1 on which a pressing tool 15 is located. As a result, pressing tool 15 can be moved in individual working steps in a pressing movement or in a pressing direction P towards a workpiece, not shown, to be pressed, which is located on a second pressing tool 16 and, in a subsequent return movement, back away from there or opposite to the pressing direction.

In the case of a forward movement of working piston 2 along working axis A, which is carried out in pressing direction P, volume V1 of upper cylinder space 31 increases and volume V2 of lower cylinder space 32 decreases and, in the case of the return movement of working piston 2 opposite to pressing direction P, volume V1 of upper cylinder space 31 increases and volume V2 of lower cylinder space 32 increases again.

Figure 2:
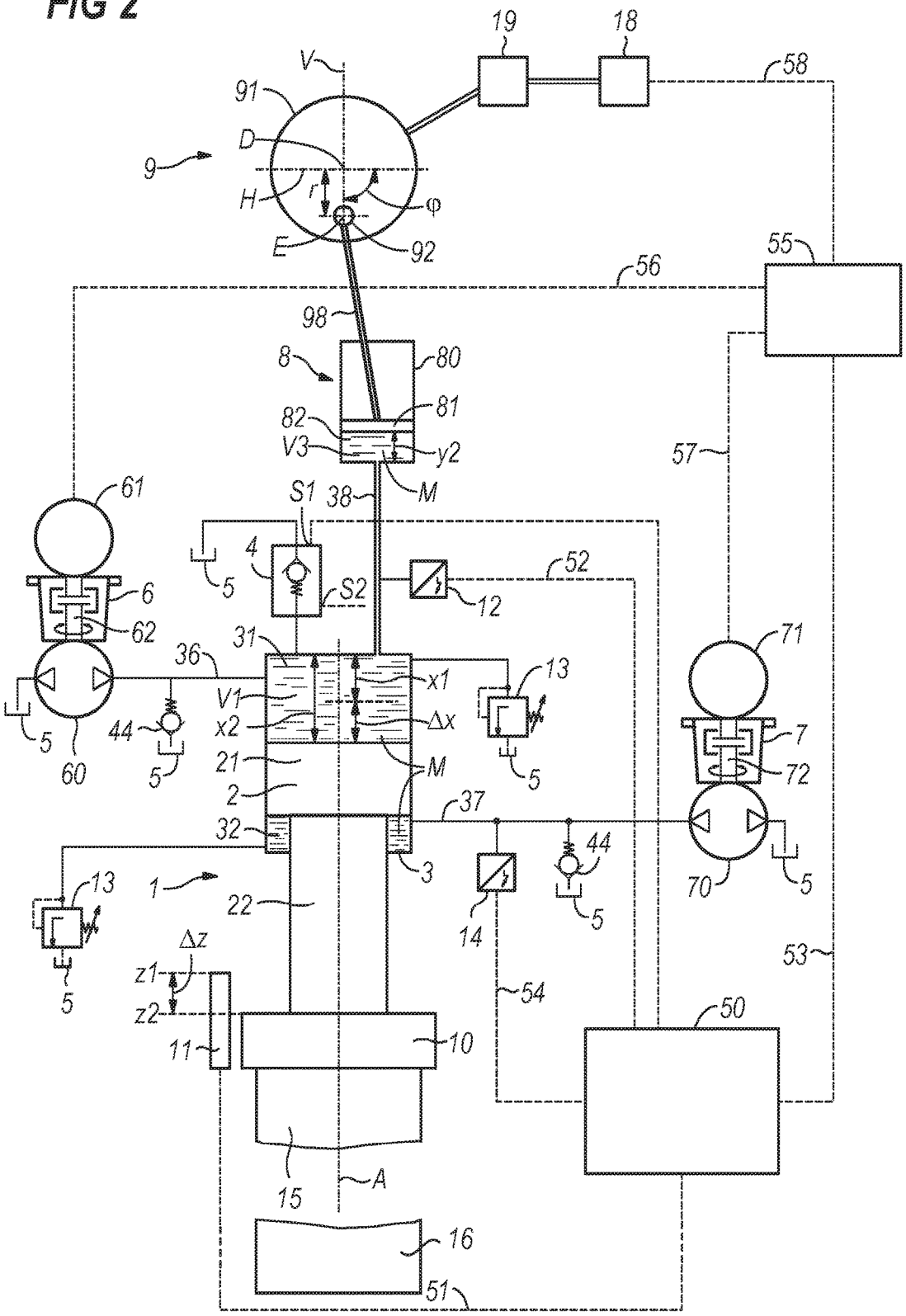
FIG. 2 shows the press according to FIG. 1, in the case of which the working piston is in a lower position.

FIG. 1 shows an upper position of working piston 2, in the case of which first piston region 21 has a distance x1 from the upper wall of working cylinder 3, and FIG. 2 shows a lower position of working piston 2, in the case of which first piston region 21 has a distance x2 from the upper wall of cylinder 3, wherein difference $\Delta x = x2 - x1$ represents the maximum working stroke or maximum travel of working piston 2 along working axis A. The corresponding volume difference in the case of maximum working stroke Δx is ΔV1=Δx A1 in upper cylinder space 31, wherein A1 is the surface area of the upper active cross-sectional surface of piston region 21 of working piston 2, and ΔV2=Δx A2 in lower cylinder space 32, wherein A2 is the surface area of the lower active cross-sectional surface, which annularly surrounds piston region 22, of piston region 21 of working piston 2. Slide 10 coupled to working piston 2 correspondingly travels an axial distance or vertical stroke between an upper position z1 (in the case of distance x1 of the working piston) and a lower position z2 (in the case of distance x2 of working piston 2), which corresponds to a maximum vertical working stroke Δz=z2−z1 of slide 10.

In general terms, slide drive unit 1 comprises a working body which is guided hydraulically in a working chamber, which is formed in the exemplary embodiment as working cylinder 3, and is formed in the exemplary embodiment as drive piston 2 which separates the working chamber into a first, preferably upper, sub-chamber and a second, preferably lower, sub-chamber. The invention is not restricted to the formation and arrangement indicated in the exemplary embodiment of the working chamber and its sub-chambers and of the working piston. For example, a cross-section which deviates from a cylinder, a horizontal arrangement of movement or also a different form of the working body or an arrangement which is, for example, star-shaped or intersected at 90°, of several working bodies and working chambers with respective slides for joint machining of a workpiece are also possible.

A controllable valve 4 is connected hydraulically to upper cylinder space 31, which controllable valve 4 is connected between upper cylinder space 31 and a medium reservoir 5 for hydraulic medium M. Control connections for opening and closing valve 4 are designated by S1 and S2. In the open state of valve 4, medium M can flow from or into medium reservoir 5 as a function of the present pressure difference, but cannot in the closed state of valve 4.

A delivery unit 60 of a servo pump 6 is furthermore connected hydraulically between medium reservoir 5 and upper cylinder space 31. Hydraulic connection line between servo pump 6 and upper cylinder space 31 is designated by 36. Delivery unit 60, for example, a screw conveyor or a delivery pump wheel or an internal gearwheel of an internal gearwheel pump, can be driven by means of an output shaft 62 of a servomotor 61 and indeed in both delivery directions by reversal of the direction of rotation of output shaft 62 of servomotor 61 as shown. Servomotor 61 is connected via an electric line 56 to an electric converter 55 which is in turn connected via an electric line 53 to control device 50

A further servo pump 7 is connected via a hydraulic connection line 37 to lower cylinder space 32 of working cylinder 3. Delivery unit 70 of second servo pump 7 is connected between connection line 37 and medium reservoir 5, which delivery unit 70 is again driven in the direction of delivery via an output shaft 62 by a servomotor 71 so as to be switchable, wherein in particular the direction of rotation of servomotor 71 can be reversed. Servomotor 71 is connected via an electric line 57 to converter 55.

A pressure transducer 14 assigned to front cylinder space 32 is connected into connection line 37, which pressure transducer 14 is connected via a line 54 to control device 50.

Unless indicated otherwise, electric lines are marked by dashed lines in FIGS. 1 to 4 and hydraulic lines are marked by continuous lines and mechanical connections are likewise marked by continuous lines. The term line or control line comprises both wire-connected and wireless, e.g. optical or radio-supported, transmission or connection passages A check valve 44 is furthermore connected in each case into hydraulic connection lines 36, 37 and 39, which check valve 44 is connected to medium reservoir 5 and respective servo pump 6, 7 and 17 is protected from idling.

Finally, upper cylinder space 31 and lower cylinder space 32 are assigned in each case an overload safety device 13 which is connected to medium reservoir 5 and limits the hydraulic pressure for protection of the components exposed to hydraulic pressure from overloading.

In the exemplary embodiment according to FIGS. 1 and 2, upper cylinder space 31 of working cylinder 3 is in hydraulic connection via a connection channel 38 to a drive cylinder space 82 of a drive cylinder 80 of a drive unit 8 for working piston 2. Drive cylinder space 82 and connection channel 38 are likewise filled with hydraulic medium M.

Volume V3 of drive cylinder space 82 can be changed by a drive piston 81 which is axially movable in drive cylinder 80 and can be driven via a connecting rod, in particular a main rod, 98 of an eccentric unit 9. Connecting rod 98 mechanically connects drive piston 81 to an eccentric 92 on an eccentric disk 91. Eccentric axis E of eccentric 92 runs eccentrically in a radius r about an axis of rotation D of eccentric disk 91 in the case of its rotation about an angle of rotation φ. A drive motor 18, in particular a torque motor with a high torque, is provided as the rotational drive for eccentric disk 91, which drive motor 18, preferably via a transmission 19, drives eccentric disk 91 in the case of a reversible direction of rotation of drive motor 18 or of transmission 19 and which is connected via an electric line 58 to converter 55.

In the position according to FIG. 1, eccentric axis E lies on a horizontal H through axis of rotation D and connecting rod 98 runs substantially vertically between eccentric 92 and drive piston 81. In the position according to FIG. 2, eccentric disc 91 is further rotated with eccentric 92 about an angle of rotation φ=90° and eccentric axis E now lies on a vertical V, which runs through axis of rotation D, and indeed below axis of rotation D so that connecting rod 98 now runs obliquely between eccentric 92 and drive piston 81. Axis of rotation D can, however, also lie precisely perpendicularly above the center of drive piston 81.

An axial movement of drive piston 81 results from this eccentric movement of eccentric unit 9. The distance of drive piston 81 from the lower wall of drive cylinder 80 is designated by y1 in FIG. 1 and by y2 in FIG. 2, wherein y1>y2. Difference Δy=y1−y2 between the positions in FIG. 1 and FIG. 2 is the maximum working stroke of drive piston 81 and corresponds on the drive side to the eccentric rotation of eccentric 92 about angle of rotation φ=90° on one hand and on the output side to maximum working stroke Δx of working piston 2 and correspondingly to maximum working stroke Δz of slide 10 on the other hand.

Maximum working stroke Δy and also the pressing or forming force which can be achieved are dependent on radius r of eccentric 92, on the selected or set maximum angle of rotation φ and on the length of connecting rod 98, which are all referred to below as eccentric parameters. The volumetric difference of volume V3 of drive cylinder space 82 which corresponds to this maximum working stroke Δy is ΔV3=Δy A3, wherein A3 is the surface area of the lower active cross-sectional surface of drive piston 81.

As a result, the pressure in medium M changes and/or, in the case of a reduction in volume V3 by movement of drive piston 81 downwards in FIGS. 1 and 2, medium M flows from drive cylinder space 82 via connection channel 38 into lower cylinder space 31 of working cylinder 3 or vice versa.

Surface A3 of drive piston 81 is generally selected to be smaller than upper surface A1 of working piston 2, wherein the ratio is determined according to the desired transmission of force which is proportional to the respective surfaces across the substantially equal pressure.

Drive unit 8 and eccentric unit 9 with drive motor 18 jointly form a first hydraulic delivery device which is connected hydraulically on one hand to the first sub-chamber of the working chamber and on the other hand to the medium reservoir and can be reversed in terms of its direction of delivery and represents a mechanical-hydraulic hybrid drive. This design provides high forming forces even or precisely at the end of the pressing travel (as a result of the variable transmission of the sinusoidal kinematics) in the case of increasing forming forces and is also particularly suitable for compression or for cold forming or for holding the slide in specific force-loaded positions, e.g. in the case of heat treatment (annealing) or for flowing operations in the workpiece. Servo pump 7 is one exemplary embodiment of a second hydraulic delivery device which is connected hydraulically on one hand to the second sub-chamber of the working chamber and on the other hand to the medium reservoir and can be reversed in terms of the direction of delivery.

Servo pump 6 however forms a third hydraulic conveying device which is connected hydraulically on one hand to the second sub-chamber of the working chamber and on the other hand to the medium reservoir and can be reversed in terms of the direction of delivery. This third hydraulic delivery device formed by servo pump 6 primarily serves to equalize leaks in the hydraulic system which can only be equalized to a limited extent by the eccentric drive due to the restricted stroke, but can additionally also be called on for assistance or as part of the first delivery device during pressing.

Figure 3:
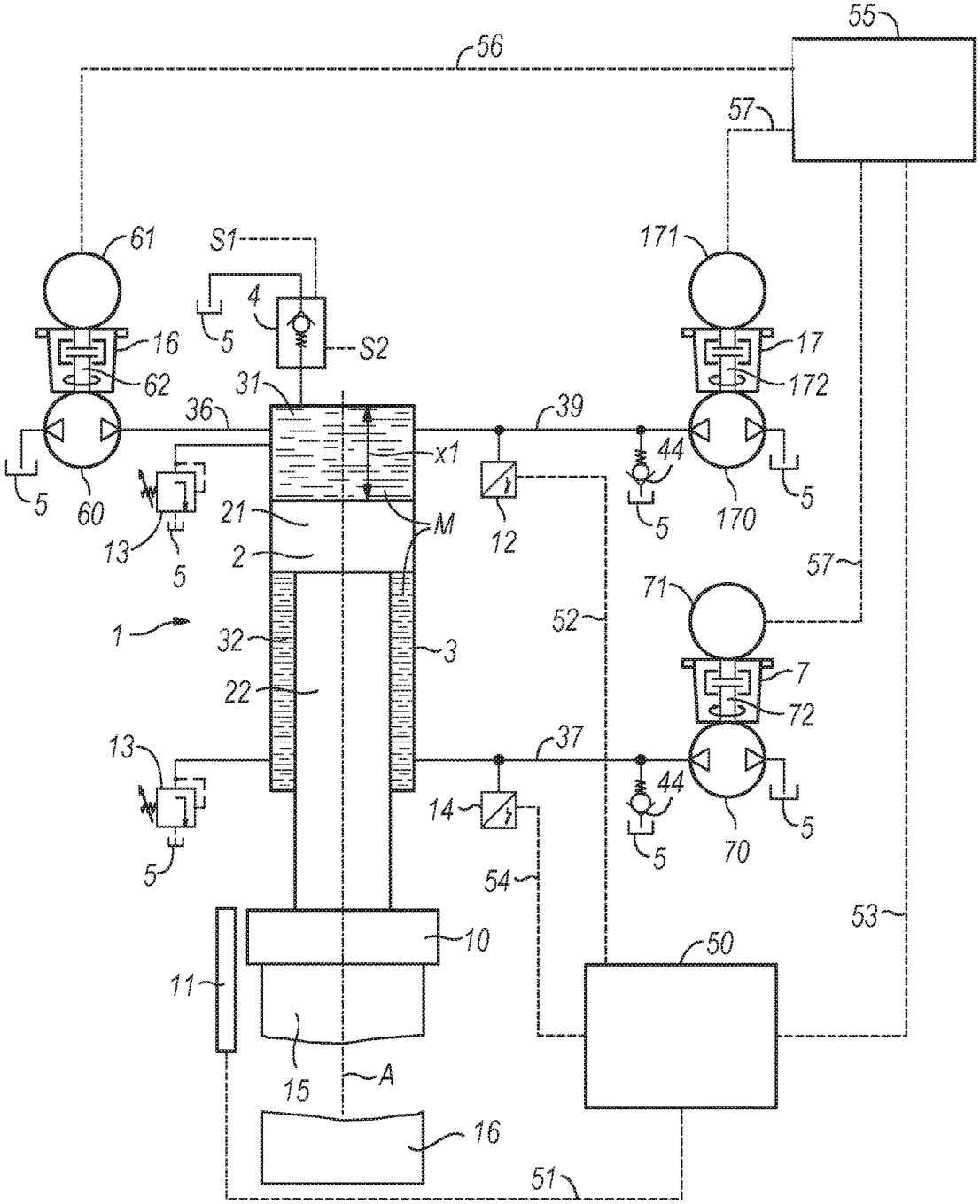
FIG. 3 shows a hydraulic press with a pump drive mechanism for the working piston, wherein the working piston is in an upper position, in a circuit diagram.
Figure 4:
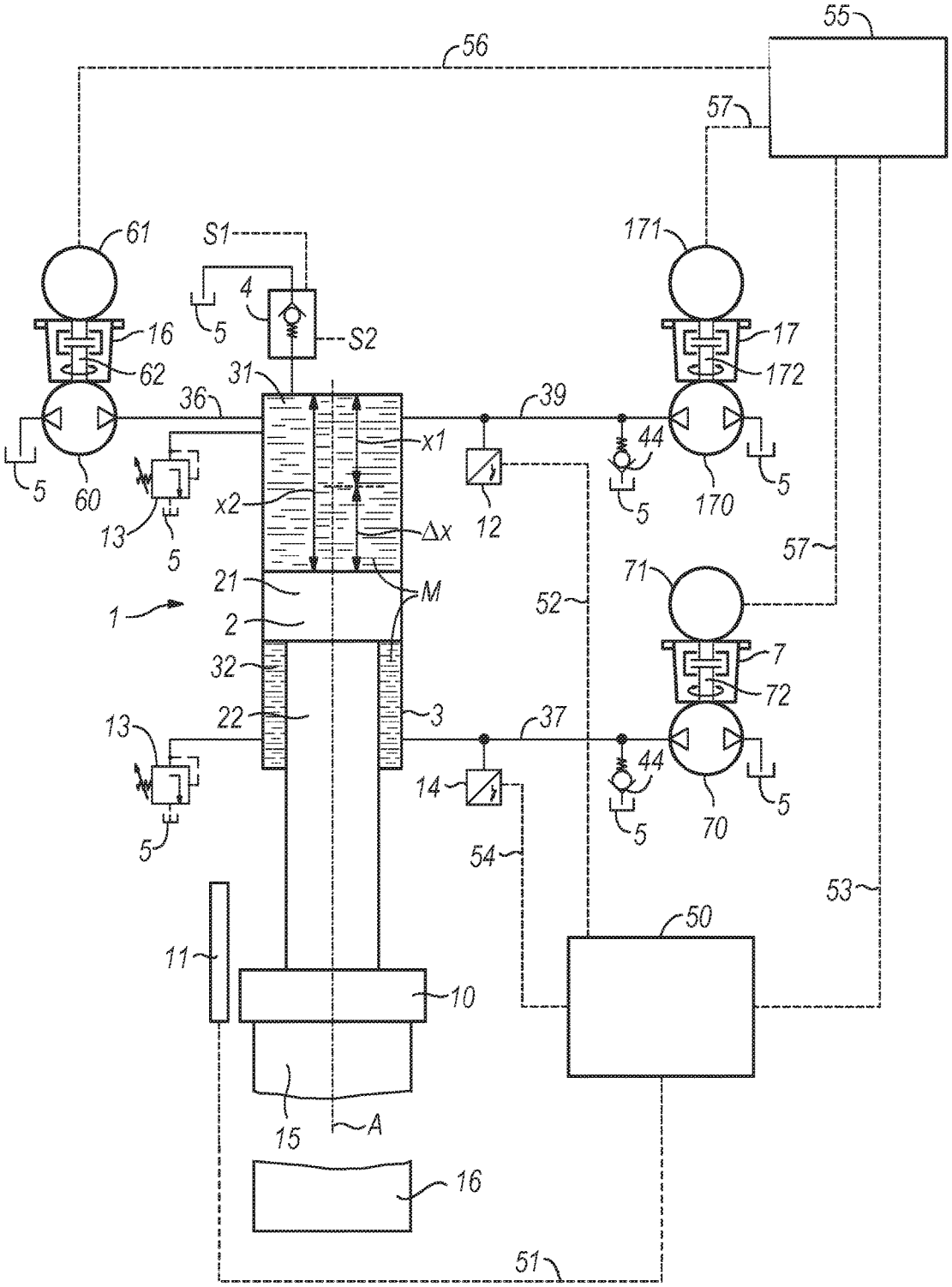
FIG. 4 shows the press according to FIG. 3, in the case of which the working piston is in a lower position, in each case schematically. Corresponding parts and variables are provided with the same reference numbers in FIGS. 1 to 4.

In the exemplary embodiment according to FIG. 3 and FIG. 4, instead of eccentric drive 9 and drive unit 8 as the first conveying device, a servo pump 17 is provided with a delivery unit 170, which is again driven via an output shaft 172 by a servomotor 171, which is connected via a line 57 to converter 55, and can be operated in both directions of delivery. Servo pump 17 is connected on one side via a hydraulic connection line 39 to rear cylinder chamber 31 of working cylinder 3 and on the other side to medium reservoir 5. A pressure transducer 12 is provided in connection line 39 for measuring the pressure in connection line 39 and thus also of rear cylinder space 31, wherein pressure transducer 12 is again connected via line 52 to control device 50. The second delivery device is furthermore formed with servo pump 7.

The third hydraulic delivery device formed with servo pump 6 thus serves in this embodiment according to FIGS. 3 and 4 for assistance of the purely hydraulic first delivery device and operates in a parallel connection to this during pressing so that the delivery volumes are added together.

The axial position of slide 10 (or also of working piston 2) along the working stroke is measured by means of an associated position measurement device or by means of a travel measurement pick-up 11 which is connected via a line 51 to a control device 50.

Control device 50 is also connected to a control connection 51 of controllable valve 4 via a line 59 in order to move the valve from the open into the closed or a less wide open state or vice versa.

Control device 50 is provided for control, in particular for open-loop control and/or closed-loop control and/or monitoring, of the working processes and individual components of the forming machine.

Control device 50 controls (or: performs open-loop or closed-loop control) via converter 55 drive motor 18 of the first hydraulic delivery device (8, 9) and servomotor 71 of the second hydraulic delivery device or servo pump 7 and via control connection S1 controllable hydraulic valve 4 for automatic open-loop or closed-loop control of the volumetric flows and pressures as well as the direction of flow of the hydraulic medium between medium reservoir 5 and the first sub-chamber (31) of the working chamber (3) and between medium reservoir 5 and the second sub-chamber (32) of the working chamber. This control of the volumetric flows, pressures and direction of flow of the hydraulic medium by control device 50 is carried out as a function of the slide position of slide 10 measured by means of slide position measurement device 11 and of stored or desired movement profiles of the slide and/or possibly of input information from users. Control device 50 thus operates in a hydraulically open open-loop or closed-loop control circuit and must actuate the two delivery devices so that that they are precisely coordinated with one another.

Converter 55 preferably comprises a temporary energy reservoir, not shown in greater detail, with which electrical energy of at least one of the delivery motors generated by generation in one process phase is temporarily stored and used in a subsequent or later process phase for motor operation of at least one of the delivery motors, preferably of the respective other delivery motor of the respective other delivery device. In particular, at least one capacitor in an intermediate circuit of the converter or in a capacitor module or kinetic energy reservoir coupled to the intermediate circuit can be used as the temporary energy reservoir of the converter.

A SINAMICS energy management system used by Siemens in the SIMOTION control units for servo presses with direct driving of the slide via servo torque motors (cf. SIMOTION brochure E20001-A660-P620 from 2008, which can be obtained at www.siemens.de/umformtechnik) can be used as temporary energy storage systems, which SINAMICS energy management system is correspondingly adapted for the servo drives (60, 70, 18, 170) of the present hydraulic press.

A method for pressing a workpiece using the press according to the invention, in particular according to FIGS. 1 and 2 or FIGS. 3 and 4, comprises the following method steps or sub-phases of each operational step or operating cycle which are checked by means of control device 50:

1. overrunning (or: idle stroke)
2. pressing stroke
3. relief of pressure (or: decompression operation)
4. controlled return stroke.

In the case of the overrunning or idle stroke mentioned under Point 1 of working piston 2 and thus of slide 10, working piston 2 moves or sinks downwards in cylinder 3 under the action of gravity, with valve 4 being at least partially opened by control device 50 in order to allow a comparatively large volumetric flow of hydraulic medium M to flow out of medium reservoir 5 into upper cylinder space 31, and the second conveying device actuated by control device 50, servo pump 7, pumps medium M out of lower cylinder space 32 into medium reservoir 5. Alternatively or additionally, servo pump 6 can also pump hydraulic medium M into upper cylinder space 31.

Control device 50 preferably controls by means of converter 55 the delivery volumetric flow or delivery pressure of the second delivery device, servo pump 7, so that the movement of working piston 2 is braked or also accelerated according to a defined movement profile, in particular travel/time profile or speed/time profile or speed/travel profile or force/time profile or force/travel profile, wherein working piston 2 moves at a defined starting point in the defined movement profile within a time provided in the movement profile or resulting therefrom. The starting point is fundamentally any desired point between the two end points of maximum working stroke Δx corresponding to a starting point of slide 10 between the two end points of maximum working stroke Δz of slide 10.

In the embodiment according to FIG. 3 and FIG. 4 without an eccentric unit, the idle stroke can also be omitted, i.e. the starting point for the working stroke can be located at the very top or the total stroke can be equal to the working stroke.

The movement of working piston 2 and thus of slide 10 during overrunning or the idle stroke is compared with the position values of position measurement device 11 by control device 50 and correspondingly adjusted or regulated by controlling valve 4 and servo pump 7 and, where applicable, also servo pump 6.

The starting point for the working stroke is preferably a point at which pressing tool 15 comes into contact with the workpiece and is thus braked which is detected or monitored by control device 50 by travel measurement by means of position measurement device 11.

During overrunning or the idle stroke, torque motor 18 (FIG. 1 and FIG. 2) or servomotor 171 (FIG. 3 and FIG. 4) is stationary, valve 4 is open and servo pump 7 is in operation. By placing pressing tool 15 on the workpiece and stopping servo pump 7, the overrunning or idle stroke movement of working piston 2 is stopped at the starting point of the working stroke.

Control device 50 begins with the pressing stroke mentioned under Point 2 which represents the actual pressing operation and during which the hydraulic pressure and thus the pressing forces are reduced. The pressing stroke is once again based on a stored, defined movement or force profile which is passed through from the starting point.

For the pressing stroke via converter 55, control device 50 puts into operation torque motor 18 of eccentric drive mechanism 9 (FIG. 1 and FIG. 2) or servomotor 171 (FIG. 3 and FIG. 4) and closes valve 4. Via eccentric drive mechanism 9 and drive unit 8 (FIG. 1 and FIG. 2) or servomotor 171 (FIG. 3 and FIG. 4), a working pressure is built up in rear cylinder space 31 of working cylinder 3, which working pressure pushes slide 10 and pressing tool 15 fastened thereon for the pressing operation downwards into or against the workpiece and presses the workpiece into the second tool. The torque of torque motor 18 and the eccentric parameters as well as the transmission of force via drive unit 8 (FIG. 1 and FIG. 2) or the torque of servomotor 171 (FIG. 3 and FIG. 4) determine the pressing force during the pressing stroke. The working stroke or pressing travel of slide 10 during the pressing stroke can be set by setting angle of rotation φ (stroke adjustment) (FIG. 1 and FIG. 2) or via the angle of rotation of servomotor 171 (FIG. 3 and FIG. 4).

The pressing movement of working piston 2 or slide 10 again follows a movement profile defined in control device 50, wherein the travel measurement again supplies via position measurement device 11 information about the location of slide 10, which information is used via control device 50 and converter 55 for control of torque motor 18 (FIG. 1 and FIG. 2) or of servomotor 171 (FIG. 3 and FIG. 4) so that slide 10 can be driven in a travel-controlled manner. It is, however, alternatively also possible to provide pressure-dependent control or travel control with an upper pressure limit. An upper limit can be set for the torque of the respective drive motor (upper pressure limit) or a torque profile can be specified in a travel-dependent manner (pressure-dependent control). In the case of torque motor 18, the torque is preferably specified dynamically so that the eccentric kinematics are taken into account. In the case of angles φ close to 90°, i.e. at the lower point, a higher hydraulic pressure can be generated with the same torque at torque motor 18.

Servo pump 7 is shifted into a low torque mode during the pressing stroke or servomotor 71 is not energized, rather generates a generator current regeneratively as a result of the medium flowing through delivery unit 70 and displaced out of lower cylinder space 32, the charge or energy of which generator current is temporarily stored by converter 55.

If e.g. slide 10 must remain in a certain position at the working pressure during the pressing stroke, e.g. for flowing operations in the workpiece, servo pump 6 can be/remain activated in order to equalize leaks by refilling hydraulic medium M from medium reservoir 5 into upper cylinder space 31 (leakage pump).

The pressing stroke is terminated if, according to FIG. 2, slide 10 reaches its lower end position (bottom dead center).

Once slide 10 has reached its lower end point, control device 50 immediately begins the return movement. This initially begins with a passive operation, the pressure relief or decompression operation stated under Point 3, in the case of which hydraulic medium M is again relieved of pressure by the compression volume which is dependent on the compressibility of medium M. Valve 4 remains closed. Torque motor 18 (FIG. 1 and FIG. 2) or servomotor 171 (FIG. 3 and FIG. 4) is shifted into a low torque mode, i.e. it can be easily rotated, the decompression of hydraulic medium M moves drive piston 81 upwards and, via eccentric disk 9, torque motor 18 is moved in the opposite direction (FIG. 1 and FIG. 2) or servo pump 170 is rotated in the opposite direction together with servomotor 171 (FIG. 3 and FIG. 4) and feeds generator energy into converter 55 and its temporary energy reservoir.

Finally the controlled return stroke stated under 4 is carried out as the fourth and last step, in the case of which controlled return stroke servo pump 7 is once again put into operation by control device 50 via converter 55, but in the opposite direction of delivery to overrunning, wherein the temporarily stored energy is reused by converter 55. Servo pump 7 pumps hydraulic medium M via line 37 out of medium reservoir 5 into lower cylinder space 32 and increases the pressure there. Valve 4 is furthermore opened again. Working piston 2 and slide 10 is as a result lifted back into the starting position or also into a different starting position by means of servo pump 7. As a result, displaced hydraulic medium M flows through open valve 4 out of rear cylinder space 31 into medium reservoir 5.

In all the exemplary embodiments according to FIG. 1 to FIG. 4, lower cylinder space 31 is assigned a pressure transducer 12 for monitoring and measuring the pressure. The signals of pressure transducer 12 are transmitted via a line 52 to control device 50. In FIGS. 1 and 2, the pressure transducer is assigned a connection line 38 between a drive cylinder space of servo pump 17 and rear cylinder space 31, while in FIGS. 3 and 4 it is assigned hydraulic line 37 between servo pump 17 and rear cylinder space 31.

Pressure transducer 12 measures the pressure for open-loop or closed-loop control of the pressure in particular for the working stroke. Pressure transducer 14 measures the pressure at front cylinder space 32 in particular also for a monitoring function, e.g. as to whether the workpiece is in contact with the pressing tool or is not even held against it which would be demonstrated in the differentiation of the threshold value for the pressure.

It is furthermore also possible to omit the idle stroke or overrunning in Step 1, for example, only for a simple stroke as a working stroke, in the case of which only the eccentric operates, which occurs e.g. in the case of stretching.

One advantage of the press and the pressing method according to the invention lies in it being possible to set the working stroke or the upper working point the lower working point of the working stroke as desired within the total stroke or maximum working stroke and the overloading can be managed safely by the pressure relief valves at any point in the stroke. Moreover, no weight compensation of the slide is required as in the case of mechanical eccentric presses. Driving via eccentric unit delivers at the lower dead center or lower working point large torques along with smaller drive output than in the case of hydraulic presses. No output-regulated hydraulic pump is required. Moreover, no flywheel is required and the eccentric can also only operate in a partial angle range.

Servo pump 6 serves in particular to equalize leaks in the hydraulic system and can pump additional hydraulic medium out of medium reservoir 5 into the hydraulic system.

Servo pumps 6, 7 and 17 are in particular hydraulic servo pumps, for example, axial piston pumps, driven with position-regulated servomotors 61, 71 and 171, which fix the pump rotors or pistons, and fitted with a hydraulic equalization reservoir, in particular medium reservoir 5.

In principle, instead of pistons and cylinders, a different configuration for the hydraulic elements can be selected so that it is then possible to talk more generally about chambers instead of cylinders and sub-chambers instead of cylinder regions or bodies instead of pistons.

Instead of the servo pumps represented and drive unit 8, other hydraulic delivery devices are furthermore also possible.

Hydraulic medium M can be an oil or also water or a mixture thereof or also a so-called HFA emulsion. The compression volume is generally higher in the case of oil than in the case of water and can, for example, be around 2 percent by volume at 300 bar.

LIST OF REFERENCE SIGNS

1 Slide drive unit
2 Working piston
3 Working cylinder
4 Return valve
5 Medium reservoir
6, 7 Servo pump
8 Drive unit
9 Eccentric unit
10 Slide
11 Distance meter
12 Pressure transducer (pressing)
13 Overload safety device
14 Pressure transducer (lifting)
15 Pressing tool
18 Drive motor (torque motor)
19 Transmission
21, 22 Piston region
31, 32 Cylinder space
36, 37 Connection line
38 Connection channel
39 Connection line
44 Pressure relief valve
50 Control device
51, 52 Line
53, 54 Line
55 Converter with intermediate circuit
56, 57 Line
58, 59 Line
60, 70 Delivery unit
61, 71 Servomotor
62, 72 Output shaft
80 Drive cylinder
81 Drive piston
82 Drive cylinder space
91 Eccentric disc
92 Eccentric
98 Connecting rod
A Working axis
M Hydraulic medium
H Horizontal
V Vertical
D Axis of rotation
E Eccentric axis
r Radius
φ Angle of rotation
x1, x2 Height
Δx Stroke

We claim:

1. A press for pressing workpieces comprising:

a) at least two pressing tools and at least one slide, on which at least one of the pressing tools is arranged and which, for pressing of workpieces, performs working movements with an associated working stroke in the case of which at least two of the pressing tools are moved towards one another;

b) at least one hydraulic slide drive unit for the slide with at least one working body which is moved or can be moved in a working chamber filled with hydraulic medium and which separates a first sub-chamber and a second sub-chamber of the working chamber from one another, wherein the slide is coupled to the working body;

c) at least one slide position measurement device for direct or indirect measurement of a position of the slide at least along the working stroke;

d) at least one medium reservoir for storing hydraulic medium, e) at least one first hydraulic delivery device, implemented as a servo pump or a servomotor drive, the first hydraulic delivery device is configured to deliver hydraulic medium in a first direction and in a reverse direction, and being connected hydraulically to the first sub-chamber of the working chamber and also to the medium reservoir;

f) at least one second hydraulic delivery device, implemented as a servo pump or a servomotor drive, the second hydraulic delivery device is configured to deliver hydraulic medium in a first direction and in a reverse direction, and being connected hydraulically on one hand to the second sub-chamber of the working chamber and on the other hand to the medium reservoir;

g) at least one controllable hydraulic valve which is connected hydraulically between the first sub-chamber of the working chamber and the medium reservoir and can be shifted between a closed state and an open state; and h) a control device which is connected to the slide position measurement device and which is operatively connected to the first hydraulic delivery device and the second hydraulic delivery device and the controllable hydraulic valve and which controls, by actuation of the first hydraulic delivery device and the second hydraulic delivery device and of the controllable hydraulic valve, the volumetric flows and pressures and the direction of flow of the hydraulic medium between the medium reservoir and the first sub-chamber of the working chamber and between the medium reservoir and the second sub-chamber of the working chamber automatically as a function of the measured slide position and stored or desired movement profiles of the slide and/or of input information from users.

2. The press as claimed in claim 1, further comprising at least one or any desired combination of the following features:

a) the working chamber is formed as a working cylinder;

b) the working body is formed as a working piston;

c) the first sub-chamber and the second sub-chamber of the working chamber form an upper and lower sub-chamber of the working chamber;

d) the working body is moved or movable vertically; and e) the slide is coupled to an underside of the working piston.

3. The press as claimed in claim 1, wherein:

the first hydraulic delivery device comprises at least one first electric delivery motor; and the second hydraulic delivery device comprises at least one second electric delivery motor; and the at least one first electric delivery motor and the at least one second electric delivery motor are connected via electric lines to a converter which is connected to the control device, wherein the at least one first electric delivery motor and the at least one second electric delivery motor can be individually actuated by at least one converter in terms of rotational speed on one hand and torque or electric output on the other hand.

4. The press as claimed in claim 3, wherein:

the converter comprises a temporary energy reservoir with which electrical energy of at least one of the delivery motors generated by generation in one process phase is temporarily stored and used in a subsequent or later process phase for motor operation of at least one of the delivery motors, of the respective other delivery motor of the respective other delivery device; and the temporary energy reservoir of the converter comprises at least one capacitor in an intermediate circuit of the converter.

5. The press as claimed in claim 1, wherein:

the first hydraulic delivery device is connected hydraulically directly, without valves or throttles connected intermediately, to the first sub-chamber of the working chamber; and the second hydraulic delivery device is connected hydraulically directly, without valves or throttles connected intermediately, to the second sub-chamber of the working chamber.

6. The press as claimed in claim 1, wherein:

a) the first hydraulic delivery device comprises at least one drive piston which adjoins a drive chamber filled with hydraulic medium and is moved or can be moved relative to the drive chamber while increasing or reducing its volume, wherein the drive chamber is connected hydraulically to the first sub-chamber of the working chamber of the slide drive unit; and b) the first hydraulic delivery device comprises at least one eccentric unit which has at least one eccentric which is rotatable about an axis of rotation within a defined rotational angle region and is arranged on an eccentric disk, which eccentric is connected via at least one connecting rod, to the drive piston and drives the drive piston in its movement with respect to the drive chamber, wherein the rotational angle region for the eccentric is arranged in a region which faces the drive piston.

7. A method for pressing workpieces by means of a press, in which a working cycle, which is checked by means of a control device taking into account position values determined by means of a position measurement device, comprises a pressing stroke, a decompression operation, and a controlled return stroke, comprising:

a) in the case of the pressing stroke, a first delivery device, implemented as a servo pump or servomotor drive, delivers medium out of a medium reservoir into a first sub-chamber in order to build up a hydraulic pressing pressure and a controllable hydraulic valve is closed and a pressing tool is pressed against the workpiece;

b) in the case of the decompression operation, the controllable hydraulic valve is closed and the first delivery device is switched off or switched into a low torque mode; and c) in the case of the controlled return stroke, a second delivery device implemented as a servo pump or servomotor drive, delivers hydraulic medium out of the medium reservoir into a second sub-chamber and the controllable hydraulic the valve is closed again so that a working body and a slide are lifted again back into a starting position or also into a different starting position and hydraulic medium displaced through open valve flows out of the second sub-chamber into the medium reservoir.

8. The method as claimed in claim 7, in which the working cycle additionally comprises overrunning prior to the pressing stroke, wherein:

a) during overrunning, the working body moves downwards in the working chamber under the action of gravity, wherein the valve is at least partially opened by the control device and the second delivery device actuated by the control device delivers medium out of the second sub-chamber into the medium reservoir, and b) during overrunning, delivery volumetric flow or delivery pressure of the second delivery device and the opening of the controllable hydraulic valve is controlled so that the movement of the working body is braked or also accelerated according to a defined movement profile, wherein the working body moves at a starting point which corresponds in particular to a point at which a pressing tool comes into contact with the workpiece, which is detected or monitored in particular by the control device by travel measurement by means of the position measurement device, and c) during overrunning, the first delivery device is stationary, the controllable hydraulic valve is opened and the second delivery device is in operation.

9. The method as claimed in claim 7, wherein:

during the pressing stroke, the second delivery device generates electric energy regeneratively, which electric energy is temporarily stored in a temporary energy reservoir of a converter and is used again in the subsequent controlled return stroke; and during the decompression operation, the first delivery device regeneratively generates electric energy which is temporarily stored in the temporary energy reservoir of the converter and is used again in the subsequent controlled return stroke by the second delivery device.

10. A press for pressing workpieces comprising:

a) at least two pressing tools and at least one slide, on which at least one of the pressing tools is arranged and which, for pressing of workpieces, performs working movements with an associated working stroke in the case of which at least two of the pressing tools are moved towards one another;

b) at least one hydraulic slide drive unit for the slide with at least one working body which is moved or can be moved in a working chamber filled with hydraulic medium and which separates a first sub-chamber and a second sub-chamber of the working chamber from one another, wherein the slide is coupled to the working body;

c) at least one slide position measurement device for direct or indirect measurement of the position of the slide at least along the working stroke;

d) at least one medium reservoir for storing hydraulic medium, e) at least one first hydraulic delivery device, implemented as a servo pump or a servomotor drive, the first hydraulic delivery device is configured to deliver hydraulic medium in a first direction and in a reverse direction, and being connected hydraulically to the medium reservoir, and being connected hydraulically directly without intermediate valves or throttles to the first sub-chamber of the working chamber;

f) at least one second hydraulic delivery device, implemented as a servo pump or a servomotor drive, the second hydraulic delivery device is configured to deliver hydraulic medium in a first direction and in a reverse direction, and being connected hydraulically to the medium reservoir, and being connected hydraulically directly without intermediate valves or throttles to the second sub-chamber of the working chamber;

g) at least one third hydraulic delivery device, implemented as a servo pump or servomotor drive, the third hydraulic delivery device is configured to deliver hydraulic medium in a first direction and in a reverse direction, and being connected hydraulically to the medium reservoir and to the first sub-chamber of the working chamber;

h) at least one of the hydraulic delivery devices being configured for generating a generator current regeneratively as a result of the medium flowing through the at least one of the hydraulic delivery devices;

i) at least one controllable hydraulic valve which is connected hydraulically between the first sub-chamber of the working chamber and the medium reservoir and can be shifted between a closed state and an open state; and j) a control device which is connected to the slide position measurement device and which is operatively connected to the first hydraulic delivery device and the second hydraulic delivery device and the controllable hydraulic valve and which controls, by actuation of the first hydraulic delivery device and the second hydraulic delivery device and of the controllable hydraulic valve, the volumetric flows and pressures and the direction of flow of the hydraulic medium between the medium reservoir and the first sub-chamber of the working chamber and between the medium reservoir and the second sub-chamber of the working chamber automatically as a function of the measured slide position and stored or desired movement profiles of the slide and/or of input information from users.

11. The press as claimed in claim 10, further comprising at least one or any desired combination of the following features:

a) the working chamber is formed as a working cylinder;

b) the working body is formed as a working piston;

c) the first sub-chamber and the second sub-chamber of the working chamber form an upper and lower sub-chamber of the working chamber;

d) the working body is moved or movable vertically; and e) the slide is coupled to an underside of the working piston.

12. The press as claimed in claim 10, wherein:

the first hydraulic delivery device comprises at least one first electric delivery motor; and the second hydraulic delivery device comprises at least one second electric delivery motor; and the at least one first electric delivery motor and the at least one second electric delivery motor are connected via electric lines to a converter which is connected to the control device, wherein the delivery motors can be individually actuated by at least one converter in terms of rotational speed on one hand and torque or electric output on the other hand.

13. The press as claimed in claim 12, wherein:

the converter comprises a temporary energy reservoir with which electrical energy of at least one of the delivery motors generated by generation in one process phase is temporarily stored and used in a subsequent or later process phase for motor operation of at least one of the delivery motors, of the respective other delivery motor of the respective other delivery device; and the temporary energy reservoir of the converter comprises at least one capacitor in an intermediate circuit of the converter.

* * * * *